United States Patent [19]

Jones

[11] 4,285,633

[45] Aug. 25, 1981

[54] BROAD SPECTRUM VIBRATION DAMPER ASSEMBLY FIXED STATOR VANES OF AXIAL FLOW COMPRESSOR

[75] Inventor: Carmen B. Jones, West Chester, Ohio

[73] Assignee: The United States of America as represented by the Secretary of the Air Force, Washington, D.C.

[21] Appl. No.: 88,503

[22] Filed: Oct. 26, 1979

[51] Int. Cl.[3] ..... F03B 3/18

[52] U.S. Cl. ..... 415/191

[58] Field of Search ..... 415/191, 192, 193, 194, 415/195

[56] References Cited

U.S. PATENT DOCUMENTS

| | | | |
|---|---|---|---|
| 2,610,823 | 9/1952 | Knowlton . | |
| 2,724,544 | 11/1955 | Hardigg | 415/194 |
| 2,930,521 | 3/1960 | Koehring . | |
| 2,931,622 | 4/1960 | Klompas et al. | 415/193 |
| 2,955,799 | 10/1960 | Oickle . | |
| 3,034,762 | 5/1962 | Fanti et al. . | |
| 3,042,365 | 7/1962 | Curtis et al. . | |
| 3,079,128 | 2/1963 | Burge | 415/191 |
| 3,126,149 | 3/1964 | Bowers et al. . | |
| 3,778,184 | 12/1973 | Wood . | |
| 3,887,299 | 6/1975 | Profant . | |
| 3,893,782 | 7/1975 | Pierpoline et al. . | |
| 4,142,827 | 3/1979 | Viciguerra | 415/193 |

*Primary Examiner*—Robert E. Garrett

*Attorney, Agent, or Firm*—Donald J. Singer; Arsen Tashjian

[57] ABSTRACT

Undesirable vibrations of stator airfoil vanes circumferentially disposed in annular rows, and fixed at their ends by a sectored outer shroud and a sectored inner shroud, in an axial flow compressor of gas turbine engine are damped by a damper assembly that is fitted into, and is frictionally engaged, in the sectored inner shroud which, in turn, is segmented to assist in this damping. The damper assembly includes: A metal seal strip member having indentations; a metal sine wave-shaped damper and spring member that is complementary to, and is engaged with, the seal strip member; and, a honeycomb member affixed to the bottom surface of the seal strip member. The vibrations cause movement of the shroud segments which, in turn, cause rubbing contact; and, the resulting friction heat energy is conducted through the metal components of the damper assembly to the thermal sink that is the through-flowing air in the compressor.

6 Claims, 5 Drawing Figures

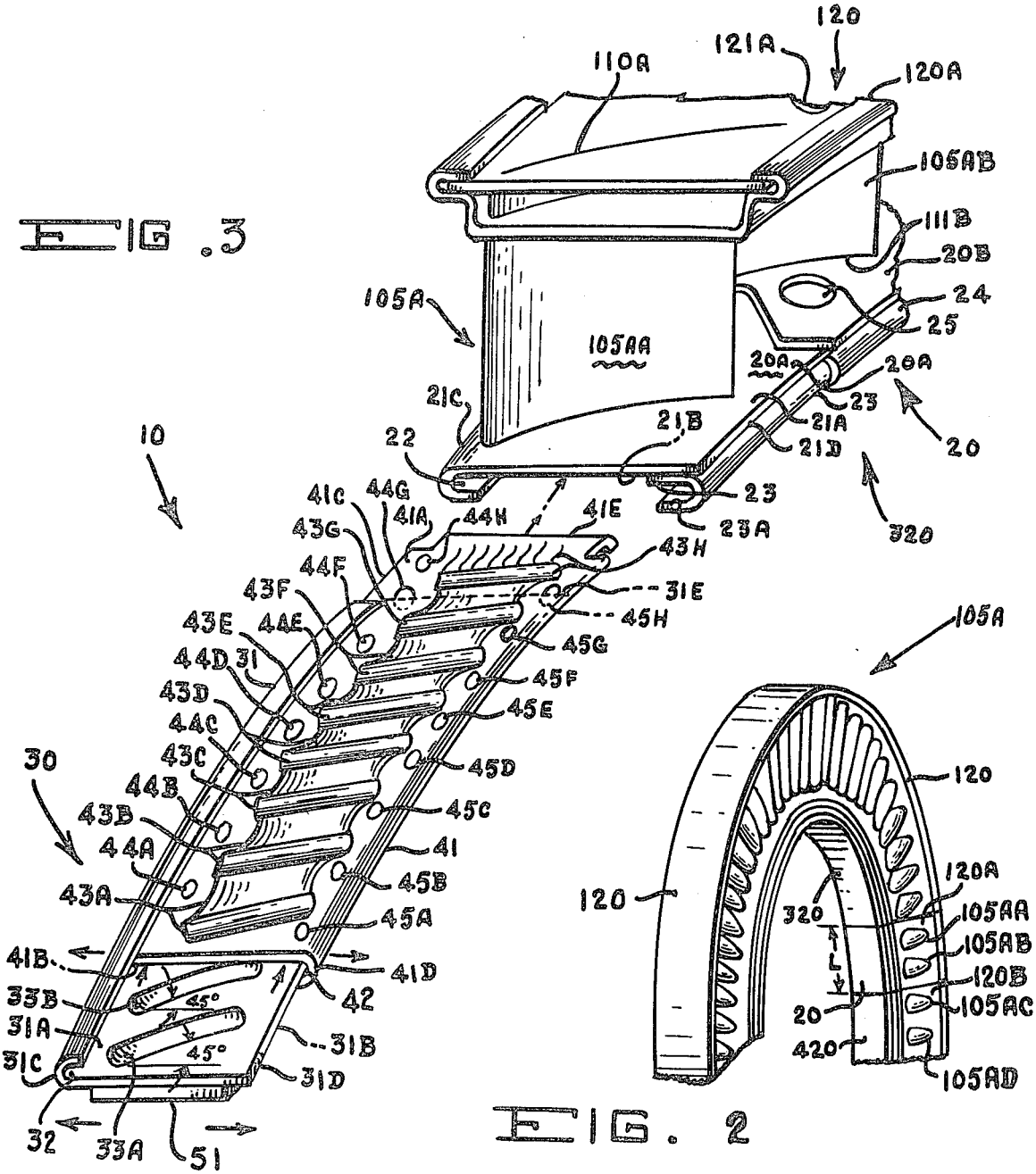
FIG. 3
FIG. 2
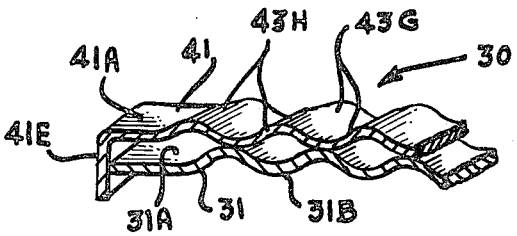
FIG. 4

BROAD SPECTRUM VIBRATION DAMPER ASSEMBLY FIXED STATOR VANES OF AXIAL FLOW COMPRESSOR

STATEMENT OF GOVERNMENT INTEREST

The invention described herein may be manufactured and used by or for the Government for governmental purposes without the payment of any royalty thereon.

BACKGROUND OF THE INVENTION

This invention relates to axial flow compressors of gas turbine engines and, more particularly, to fixed stator vanes thereof.

One of the advances in the state-of-the-art of axial flow compressors has been the fabrication of fixed stator vane rows in sectors (i.e., sections or portions). However, detailed experimental investigations of the aeromechanical response displayed by these sectored stator vane rows, have revealed vibratory stress levels, in several lower modes, that are higher than is compatible with satisfactory long term service life.

My invention alleviates these high vibratory stress levels; and, thereby, constitutes a significant advance in the state-of-the-art.

SUMMARY OF THE INVENTION

This invention is a broad spectrum vibration damper assembly for use in a gas turbine engine having an axial flow compressor with a plurality of stator airfoil vanes that are disposed circumferentially in an annular row, wherein air flows into and through the comressor, (and, of course, the stator airfoil vanes in each row of vanes), and wherein the vanes have vibratory stress levels that are unacceptably high.

Accordingly, the principal object of this invention is to provide a preferred embodiment which teaches the structure of my inventive damper assembly.

This principal object, as well as other related objects, of my invention will become readily apparent after a consideration of the description of the invention, together with reference to the Figures of the drawings.

DESCRIPTION OF THE DRAWINGS

FIG. 2 is a perspective view, in simplified form of a typical annular row of stator airfoil vanes for use in an axial flow compressor, with the vanes interposed between a sectored outer shroud and a sectore inner shroud;

FIG. 3 is an exploded perspective view, in simplified schematic form and partially fragmented, of the preferred embodiment of the invention;

FIG. 4 is a side elevation view, in simplified form and partially fragmented, of two components of the invention, in abutting contact.

DESCRIPTION OF THE PREFERRED EMBODIMENT

Figure 1:
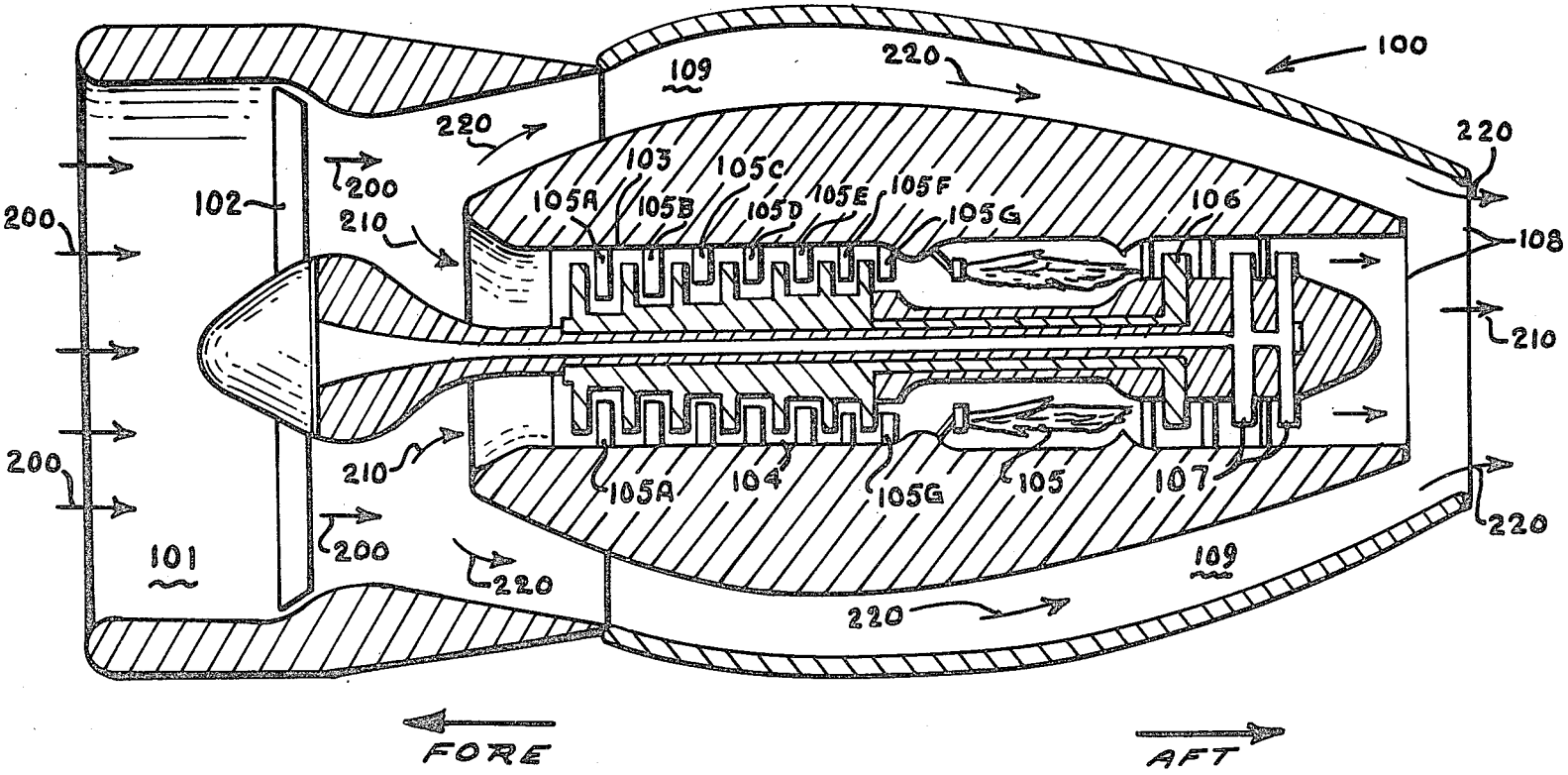
FIG. 1 PRIOR ART
FIG. 1 is a side elevation view, in simplified schematic form in cross section, of a typical gas turbine engine having an axial flow compressor.

As a preliminary matter, reference is made to FIG. 1 wherein a typical gas turbine engine 100 is shown with "Fore" and "Aft" designations to better orient the vender. The engine 100 includes: the air inlet 101, the fan 102 (since the engine shown is, as a matter of preference and not of limitation, one of the turbofan type); the axial (flow) compressor section 103, with the axial flow compressor 104 and representative rows of stator airfoil vanes 105A–105G, inclusive; the turbine 106 (of the compressor 104); the fan tubine 107; and, the exhaust nozzle 108. Also shown is the intake air flow 200 which divides into the primary jet air flow 210 (also referred to herein as the "compressor air flow"), and the fan duct bypass air flow 220 which moves aft toward the exhaust nozzle 108 in the fan duct 109 and rejoins the primary jet air flow 210 at the exhaust nozzle 108.

With reference to FIG. 2, therein is shown a typical annular row 105A, of a plurality of annular rows (such as 105A–105G, FIG. 1), of fixed stator airfoil vanes (such as representative ones 105AA, 105AB, 105AC and 105AD) interposed between a sectored outer shroud assembly 120, having a plurality of constituent sectors (such as representative ones 120A and 120B), and a sectored inner shroud assembly 320, having a plurality of constituent sectors (such as representative ones 20 and 420).

Figure 5:
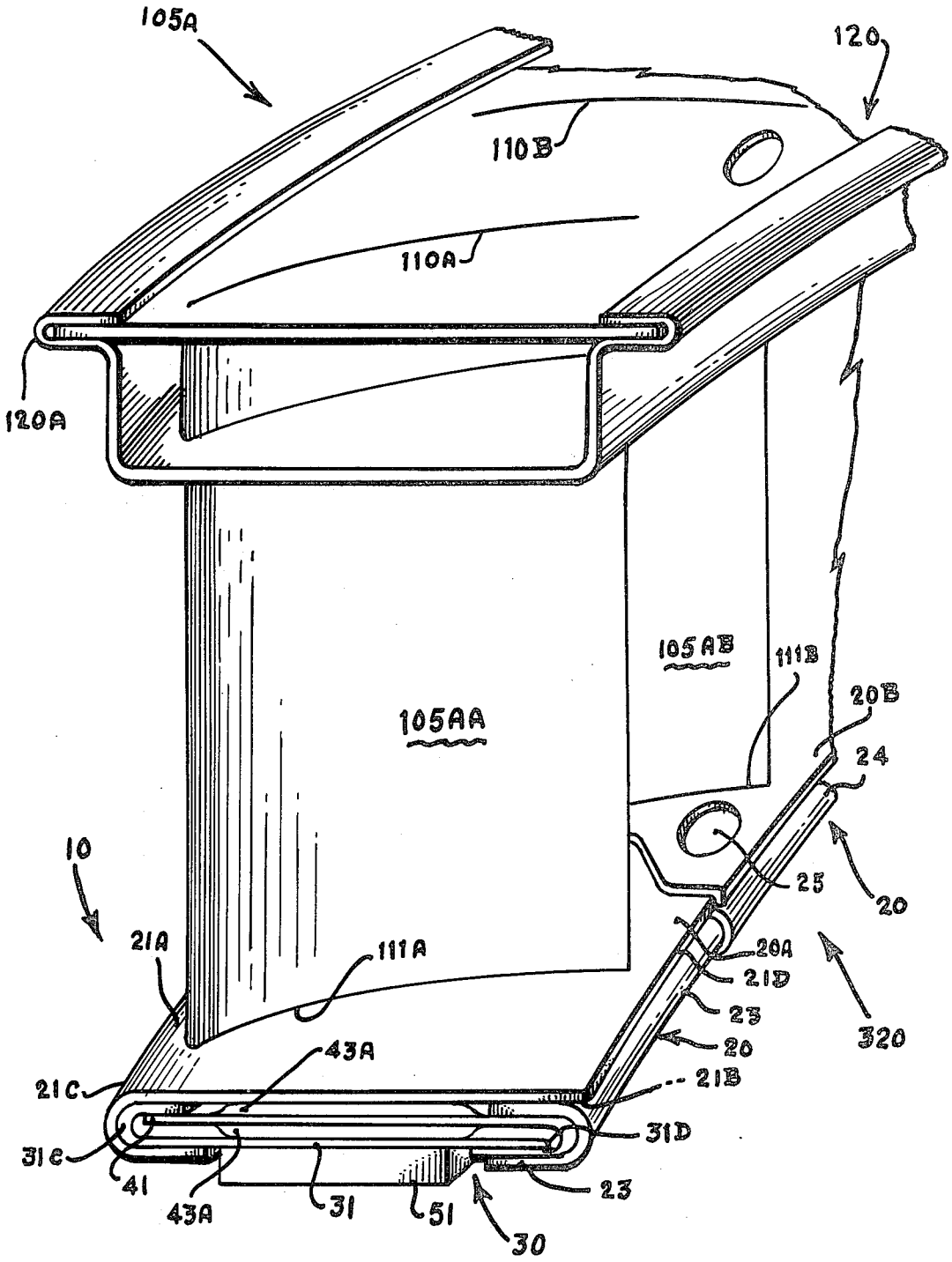
FIG. 5 is a perspective view, in simplified schematic and pictorial form, and partially fragmented, of the preferred embodiment of the invention shown in FIG. 3, in assembled condition.

With reference to FIGS. 3, 4 and 5, therein is shown, in perspective views, a preferred embodiment 10 of my inventive broad spectrum vibration damper assembly. The inventive assembly 10, as shown in FIG. 3, is in an exploded condition; and, as shown in FIG. 5, is in an assembled condition. It is to be remembered, as previously stated, that the invention is for use in a gas turbine engine (such as 100, FIG. 1) that has an axial flow compressor (such as 104, FIG. 1) with a plurality of circumferential annular rows of stator airfoil vanes (such as 105A–105G, inclusive, FIG. 1 and 105A, FIG. 2) with air (such as 210, FIG. 1) flowing into and through the compressor 104.

Still with reference to FIGS. 3 and 5, more specifically, the invention broad spectrum vibration damper assembly 10, FIGS. 3 and 5, is for use with an axial flow compressor with a plurality of stator airfoil vanes (such as representative ones 105AA and 105AB, FIGS. 2, 3 and 5, of stator row 105A, FIGS. 1–3 and 5) that are disposed circumferentially in an annular row (such as 105A, FIGS. 1 and 2) with each airfoil vane having an outer end (such as 110A for vane 105AA, FIGS. 3 and 5; and, such as 110B for vane 105AB, FIG. 5) and an inner end (such as 111A for vane 105AA, FIGS. 3 and 5; and, such as 111B for vane 105AB, FIGS. 3 and 5), with each outer end affixed to a common outer shroud (such as 120, FIGS. 2, 3 and 5) for that row (such as 105A, FIGS. 1–3 and 5, in this case).

In the most basic and general structural form, the invention assembly 10, FIGS. 3–5, inclusive, comprises: (a) a common sectored inner shroud (such as 120, FIGS. 2, 3 and 5), with each sector (such as representative one 20, FIGS. 2, 3 and 5) divided into a plurality of similar constituent segments (such as 20A and 20B, FIGS. 3 and 5), with each inner shroud segment (such as representative one 20A, FIGS. 3 and 5) having an outer surface 21A, an inner surface 21B, a leading edge 21C, and a trailing edge 21D, and with the inner end of at least one stator airfoil vane (such as inner end 111A of vane 105AA) affixed to the outer surface 21A of each inner shroud segment (such as 20A), and with the leading edge (such as 21C) of each segment curved below the inner surface (such as 21B) of that segment (such as 20A) and also curved toward the trailing edge (such as 21D) of that segment, so that a leading edge channel (such as 22, FIG. 3) is formed and defined for each segment; (b) a channel member (such as 23, FIGS. 3 and 5) that is affixed to the inner surface (such as 21B) of each of the inner shroud segments (such as 20A) at the trailing edge (such as 21D) of the segment, with each channel member (such as 23 and 24, FIG. 3) having a channel (such as 23A, FIG. 3, for channel member 23) similar to, and facing, the leading edge channel (such as 22) of its respective inner shroud segment (such as 20A), such that the channel member channel (such as 23A) constitutes a trailing edge channel of the particular inner shroud segment (such as 20A); and, (c) a damper and seal subassembly, such as is generally designated 30, FIGS. 3 and 5, for each sector of the inner shroud 320, with each such subassembly fitted into, and frictionally engaged with, the leading edge channel (such as 22, FIGS. 3 and 5) and the respective trailing edge channel (such as 23A, FIGS. 3 and 5) of the segments (such as 23 and 24, FIGS. 3 and 5) of a different one of the sectors (such as 20) of the inner shroud 320.

In turn, each damper and seal subassembly (such as 30, FIGS. 3–5, inclusive) includes: (a) a seal strip member 31 of the same length "L", FIG. 2, as its respective inner shroud sector 20, FIGS. 2, 3 and 5, and that has an outer surface 31A, an inner surface 31B, and leading edge 31C, a trailing edge 31D, and a first end 31E, with the leading edge 31C curved above the outer surface 31A and toward the trailing edge 31D, so that a leading edge channel (such as 32, FIG. 3) is formed and defined, with this leading edge channel 32 sized smaller than, and complementary to, the leading edge channel (such as 22, FIG. 3) of the constituent segments (such as 23 and 24, FIG. 3) of its respective inner shroud sector (such as 20), and with the outer surface 31A having a plurality of equally spaced, rectangular-like shaped, identical indentations (such as representative indentations 33A and 33B, FIG. 3) therein; (b) a damper and spring member 41 having an outer surface 41A, an inner surface 41B, a leading edge 41C, a trailing edge 41D; and a first end 41E, with the trailing edge 41D curved under the inner surface 41B and toward the leading edge 41C, so that a trailing edge channel 42 is formed and defined which is sized smaller than, and is complementary to, the trailing edge channel (such as 23A of the constituent segments (such as 23 and 24) of its respective inner shroud sector (such as 20), and with this member 41 fitted over the trailing edge 31D of the seal strip member 31, and with the outer and inner surfaces 41A and 41B of this member 41 having a common plurality of equally spaced, identical, sine wave-like corrugations (such as representative ones 43A–43H inclusive, FIG. 3) therein (which make the member 41 structural wavy, and make it function spring-like when compressed) that are complementary to, and are fitted over and into, the plurality of indentations (such as 33A and 33B) in the seal strip member 31, and also with the outer and inner surfaces 41A and 41B of this member 41 having a first plurality of aligned perforations (such as 44A–44H, inclusive, FIG. 3) therein and therethrough that are adjacent to and aft of the leading edge 41C of this member 41, and a second plurality of aligned perforations (such as 45A–45H, inclusive) therein and therethrough that are adjacent to and fore of the trailing edge 41D of this member 41, and further with a portion of the leading edge 41C and a portion of the trailing edge 41D of this member 41 removed from and at the first end 41E, with the first end 41E bent over, and in abutting contact with, the first end 31E of the seal strip member 31 (see FIG. 4); and, (c) a seal matrix member 51 that is made of a cellular material and is affixed to the inner surface 31B of the seal strip member 31 between the leading edge 31C and the trailing edge 31D of the seal strip member 31, and is sized and is disposed between the leading edge channel (such as 22) and the trailing edge channel (such as 23A) of the constituent segments (such as 23 and 24) of its respective inner shroud sector (such as 20).

It is to be noted that, as a matter of preference and not of limitation: (a) the equally spaced, rectangular-like shaped, identical indentations (such as 33A and 33B) in the outer surface 31B of the seal strip member 31 are positioned, relative to each other, at a constant pitch, and are each inclined at a 45 degree angle; (b) the equally spaced, identical, sine wave-like corrugations (such as 43A–43H, inclusive) in the damper and spring member 41 are positioned, relative to each other, at a constant pitch, are each inclined at a 45 degree angle, and also are positioned at the same pitch as the indentations (such as 33A and 33B) that are in the outer surface 31A of the seal strip member 31; (c) the sector 120A or the outer shroud 120, FIGS. 2, 3 and 5, has a port 121A therein and therethrough, and the sector 20 of the inner shroud 320 has a port (such as 25, FIGS. 3 and 5) therein and therethrough that is in alignment with the port 121A in the outer shroud 120; (d) the inner shroud 320 is segmented (i.e., divided) into the same number of segments (such as 23 and 24) as there are stator airfoil vanes (such as vane 105AA for segment 23, vane 105AB for segment 24, and the like); (e) the inner shroud 320 and the channel member (such as 23) are made of metal; and (f) the metal seal strip member (such as 31) is made of "Inco 600" metal, and the damper and spring member (such as 41) is made of "Inconel X 750" metal.

MANNER OF OPERATIONS AND USE OF THE PERFERRED EMBODIMENT

The manner of operation and of use of the preferred embodiment 10, FIGS. 3–5, inclusive, of the inventive damper assembly can be easily ascertained by any person of ordinary skill in the art from the foregoing description, coupled with reference to Figures of the drawing.

For others, the following simplified explanation is offered:

The undesirable vibrations are damped by the cooperative action of the segments of the inner shroud, and the damper assembly. More specifically, the vibrations cause the fixed stator airfoil vanes to vibrate (i.e., mechanical energy), thereby causing the shroud segments to move, contact and rub (i.e., friction heat energy). That heat energy is conducted through the metal seal strip member and the metal damper and spring member of the damper assembly and, from these members, into the air which flows through the axial flow compressor. That flowing air functions as a heat sink for the conducted friction heat energy.

CONCLUSION

It is abundantly clear from all of the foregoing, and from the Figures of the drawings, that the stated desired principal object, as well as related objects, of the invention have been achieved.

It is to be noted that, although there have been described and shown the fundamental and unique features of our invention as applied to a preferred embodiment, various other embodiments, variations, adaptations, substitutions, additions, omissions, and the like may occur to, and can be made by, those of ordinary skill in the art, without departing from the spirit of the invention.

What is claimed is:

1. A broad spectrum vibrations damper assembly for use in a gas turbine engine having an axial flow compressor with a plurality of stator airfoil vanes disposed circumferentially in an annular row, with each vane having an outer end and an inner end, and with said outer end of each vane affixed to a common sectored outer shroud, wherein air flows into and through said compressor, comprising:

a. a common sectored inner shroud, with each sector divided into a plurality of similar constituents segments, wherein each inner shroud segment has an outer surface, an inner surface, a leading edge, and a trailing edge with said inner end of at least one vane affixed to said outer surface of said inner shroud segment, and with said loading edge of each said segment curved below said inner surface of said segment and also curved toward said trailing edge of said segment, thereby forming and defining a leading edge channel for each segment;

b. a channel member affixed to said inner surface of each said inner shroud segment at said trailing edge therof, with each said channel similar to, and facing, said leading edge channel of its respective inner shroud segment, whereby said channel member channel constitutes a trailing edge channel of said inner shroud segment;

c. and, a damper and seal subassembly, one such subassembly for each sector of said inner shroud, with each such subassembly fitted into, and frictionally engaged with, said leading edge channel and said trailing edge channel of said segments of a different one of said sectors of said inner shroud, wherein each said subassembly includes:

(1) a metal seal strip member of the same length as its respective inner shroud sector, and having an outer surface, and inner surface, a leading edge, a trailing edge, and a first end, with said leading edge curved above said outer surface and toward said trailing edge, thereby forming and defining a leading edge channel that is sized smaller than, and is complementary to, said leading edge channel of said constituent segments of its respective inner shroud sector, and with said outer surface having a plurality of equally spaced, rectangular-like shaped, identical indentations therein (2) a metal damper and spring member having an outer surface, an inner surface, a leading edge, a trailing edge, and a first end, with said trailing edge curved under said inner surface and toward said leading edge, thereby forming and defining a trailing edge channel that is sized smaller than, and is complementary to, said trailing edge channel of said constituent segments of its respective inner shroud sector, and is fitted over said trailing edge of said seal strip member, and with said outer and inner surfaces of this damper and spring member having a common plurality of equally spaced, identical, sine-wave-like corrugations therein complementary to, and fitted on, said seal strip member and its plurality of indentations, and also with said outer and inner surfaces of this damper and spring member having a first plurality of aligned perforations therein adjacent to and aft of said leading edge of said damper and spring member, and also having a second plurality of aligned perforations therein adjacent to and fore of said trailing edge of said damper and spring member, and further with a portion of said leading edge and a portion of said trailing edge of said damper and spring member removed from and at said first end, with said first end bent over, and in contact with, said first end of said seal strip member;

(3) and, a seal matrix member, made of cellular material, affixed to said inner surface of said seal strip member between said leading edge and said trailing edge thereof, and disposed between said leading edge channel and said trailing edge channel of said constituent segments of its respective inner shroud sector.

2. A broad spectrum vibration damper assembly, as set forth in claim 1, wherein said equally spaced, rectangular-like, identical indentations in said outer surface of said seal strip member are positioned, relative to each other, at a constant pitch, and are each inclined at a 45 degree angle.

3. A broad spectrum vibration damper assembly, as set forth in claim 2, wherein said equally spaced, identical, sine wave-like corrugations in said damper and spring member are positioned, relative to each other, at a constant pitch, and are each inclined at a 45 degree angle, and also are positioned at the same pitch as said indentations in said outer surface of said seal strip member.

4. A broad spectrum vibration damper assembly, as set forth in claim 3, wherein said outer shroud of said plurality of stator airfoil vanes has a port therein and therethrough, and wherein said inner shroud has a port therein and therethrough in alignment with said port in said outer shroud.

5. A broad spectrum vibration damper assembly, as set forth in claim 4, wherein said inner shroud is segmented into the same number of segments as there are stator airfoil vanes.

6. A broad spectrum vibration damper assembly, as set forth in claim 5, wherein said inner shroud and said channel member are each made of metal.

* * * * *